US010233689B1

(12) United States Patent
Jones

(10) Patent No.: US 10,233,689 B1
(45) Date of Patent: Mar. 19, 2019

(54) WINDOW GLAZING SYSTEM

(71) Applicant: PEERLESS PRODUCTS, INC., Fort Scott, KS (US)

(72) Inventor: Tehcaube L. Jones, Nevada, MO (US)

(73) Assignee: Peerless Products, Inc., Fort Scott, KS (US)

( * ) Notice: Subject to any disclaimer, the term of this patent is extended or adjusted under 35 U.S.C. 154(b) by 0 days.

(21) Appl. No.: 15/726,319

(22) Filed: Oct. 5, 2017

Related U.S. Application Data

(60) Provisional application No. 62/405,076, filed on Oct. 6, 2016.

(51) Int. Cl.

| | |
|---|---|
| ***E06B 1/36*** | (2006.01) |
| ***E06B 3/58*** | (2006.01) |
| ***E06B 7/14*** | (2006.01) |
| *E06B 3/62* | (2006.01) |

(52) U.S. Cl.
CPC ..... *E06B 3/5885* (2013.01); *E06B 1/36* (2013.01); *E06B 7/14* (2013.01); *E06B 2003/6247* (2013.01)

(58) Field of Classification Search
CPC ..... E06B 1/16; E06B 2003/26314; E06B 3/26303; E06B 3/26305; E06B 3/26307; E06B 3/273; E06B 2003/26389
USPC ..... 52/62
See application file for complete search history.

(56) References Cited

U.S. PATENT DOCUMENTS

| | | | | |
|---|---|---|---|---|
| 8,353,138 | B2 | 1/2013 | Sigmund et al. | |
| 2004/0255529 | A1 | 12/2004 | Pielmeier | |
| 2008/0282628 | A1* | 11/2008 | Lenox | E06B 3/26303 52/204.63 |
| 2009/0313941 | A1* | 12/2009 | Siodla | E06B 3/26303 52/800.13 |
| 2014/0260072 | A1* | 9/2014 | McKenna | E04B 1/78 52/741.4 |
| 2015/0224855 | A1* | 8/2015 | Legrand | B60J 1/008 52/204.62 |

FOREIGN PATENT DOCUMENTS

| | | | | |
|---|---|---|---|---|
| DE | 20003060 | U1 * | 4/2000 | E06B 3/2632 |
| DE | 102012100016 | A1 * | 7/2012 | E06B 3/305 |
| DE | 102011017087 | A1 * | 10/2012 | E06B 3/56 |
| EP | 0866203 | A2 * | 9/1998 | E06B 3/26303 |
| EP | 1201868 | A1 * | 5/2002 | E06B 3/26303 |
| FR | 2761400 | A1 * | 10/1998 | E06B 3/2632 |
| JP | 05287966 | A | 11/1993 | |

* cited by examiner

*Primary Examiner* — Babajide A Demuren
(74) *Attorney, Agent, or Firm* — Lathrop Gage L.L.P.

(57) ABSTRACT

A window system has a window frame that surrounds a window unit. The window frame has a glazing leg with an outer wall and an inner wall. The inner wall forms a J-shaped stem, which forms a J-shaped channel between the inner wall and the outer wall. A first gasket engages with the outer wall, and is maintained in compression between the outer wall and the window unit. Likewise, a second gasket engages with the inner wall, and is maintained in compression between the inner wall and the window unit.

17 Claims, 6 Drawing Sheets

WINDOW GLAZING SYSTEM

CROSS-REFERENCE TO RELATED APPLICATIONS

This application claims priority to U.S. Provisional Patent Application No. 62/405,076, filed Oct. 6, 2016, the entirety of which is incorporated by reference herein.

BACKGROUND

Windows must be sealed from the elements in order to protect both the integrity of the window and the finished interior of a building. Traditionally, liquid sealants are used, such a silicone, as the means for managing air and water within the window system. Often silicone is applied in a thin strip, or applied with skips in the bead creating pin sized holes allowing water to penetrate to the interior of the building. Cured liquid sealants can shear or separate during product handling and are not visible, creating the opportunity for water to enter the building.

Additionally, in nearly all the current window glazing systems, at the corner joints, a bead of liquid sealant is placed along the profiled edge of the corner. This sealant bead is then compressed between the two frame members. The sealant is compressed to such a thin amount that if the window is handled poorly during transportation or installation, the sealant can shear or separate from itself. This will allow water to enter the frame and eventually enter the building.

A window system that is superiorly effective at sealing out the elements is desirable.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a window system includes a window frame surrounding a window unit. The window frame includes a glazing leg and a glazing bead separated by a thermal break. The glazing leg is disposed on a first side of the window unit and the glazing bead is disposed on a second opposing side of the window unit. The glazing leg includes a J-shaped stem forming a J-channel configured to direct liquid away from the window unit.

In another embodiment, a window system includes an insulated glass unit having a first side and a second side; and a window frame surrounding the insulated glass unit. The window frame has a glazing leg with an outer wall and a J-shaped inner wall. The outer wall forms a first opening for receiving a first gasket, and the inner wall forming a second opening for receiving a second gasket. The first gasket is disposed between the glazing leg and the first side of the insulated glass unit and the second gasket is disposed inboard of the first gasket between the glazing leg and the first side of the insulated glass unit. A glazing bead disposed on an opposite side of the insulated glass unit from the glazing leg, and is separated from the glazing leg via a thermal spacer. The glazing bead forms a third opening for receiving a third gasket. The insulated glass unit is maintained in position between the first, second, and third gaskets, each respective gasket being compressed between the respective glazing leg or glazing bead and the insulated glass unit.

In still another embodiment, a window system has a window frame that surrounds a window unit. The window frame has a glazing leg with an outer wall and an inner wall. The inner wall forms a J-shaped stem, which forms a J-shaped channel between the inner wall and the outer wall. A first gasket engages with the outer wall, and is maintained in compression between the outer wall and the window unit. Likewise, a second gasket engages with the inner wall, and is maintained in compression between the inner wall and the window unit.

DRAWINGS

DETAILED DESCRIPTION

The window system described herein is constructed without the use of traditional liquid sealants. In the place of traditional liquid sealants, gaskets may be disposed around the edge of the window using a compression technique to create air and water barriers or channels within the window system. Utilizing gaskets as taught herein may improve the reliability of the window system by eliminating the requirement that the manufacturer must properly apply a bead of silicone with adequate thickness across large expanses and intricate profiles in order to seal the window from the elements. A further benefit of using gaskets as described herein is the ability for a user to conduct a quick and accurate visual inspection of the window system for quality and completeness.

Embodiments of layered dual gasket window systems are described herein. The window system may utilize a primary and secondary gasket compressed against the glass to improve reliability of the window system. As will be further described below, the system works by using the primary gasket to reduce the amount of adverse environmental elements (e.g., moisture, light, etc.) that come in contact with the secondary gasket. Thus, the primary gasket is intended to eliminate water and any ultraviolet light exposure to the secondary gasket. The secondary gasket, in turn, provides reassurance against water penetration and creates an air tight seal meeting strict AAMA (American Architectural Manufacturers Association) requirements.

The secondary gasket is presented to the glass via a unique "J" shaped stem. The gap between the two gaskets provides an alley allowing any water that should penetrate the primary gasket to shed off the secondary gasket and fall harmlessly into the channel created by the "J" shaped stem. This channel funnels water to the exterior of the building through weeps located in the sill of the window. A corner profile gasket designed to encompass the corner profiles of the frame ensures an even and complete seal across the entire joint. The corner profile gaskets described herein are simple to apply and are extremely reliable.

The dual gaskets may be disposed at the glazing leg. More particularly, the glass to window frame seal may include two perimeter gaskets installed on the glazing leg of the window frame, including one primary, exterior gasket and one secondary, internal gasket, which may each be compressed to the glass.

Figure 1:
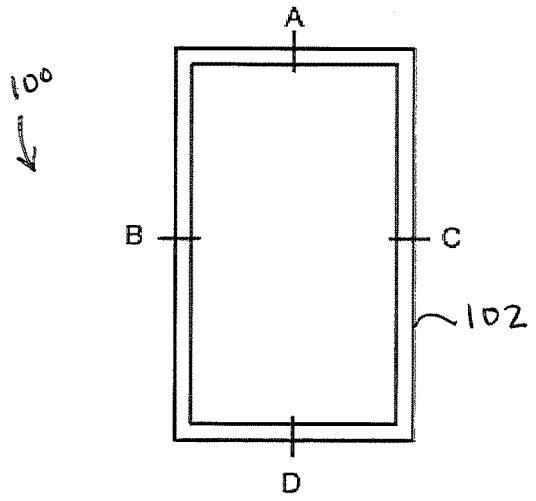
FIG. 1 is a front view of a window showing the head (A), sill (D), and jambs (B) and (C).
Figure 2:
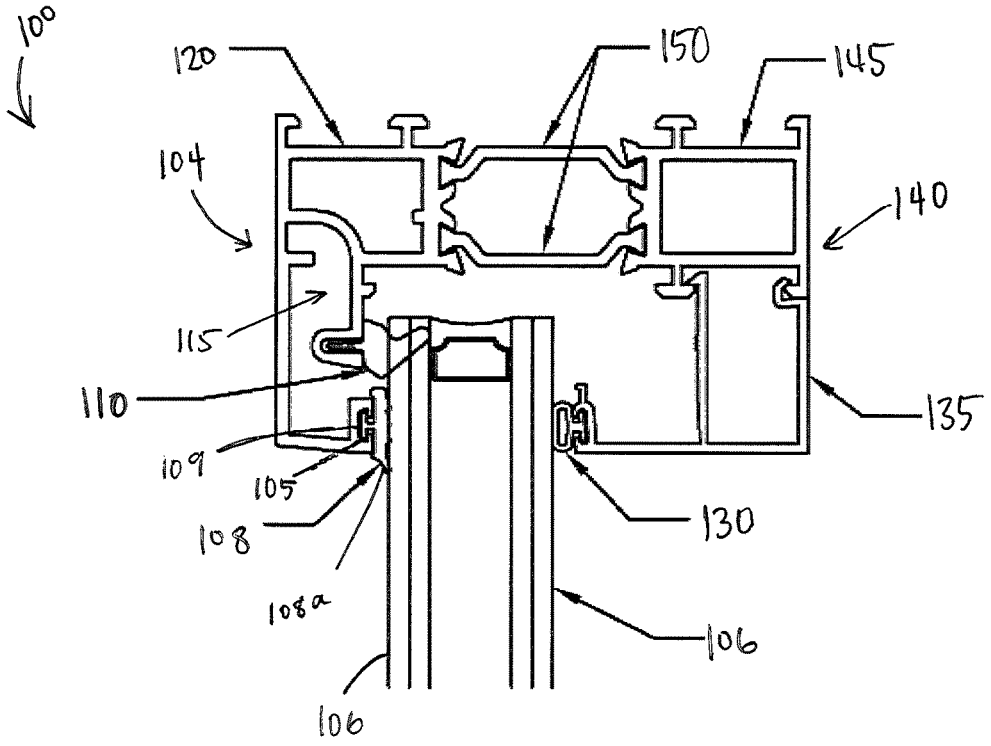
FIG. 2 is a section view of the head (A) of the window.
Figure 3:
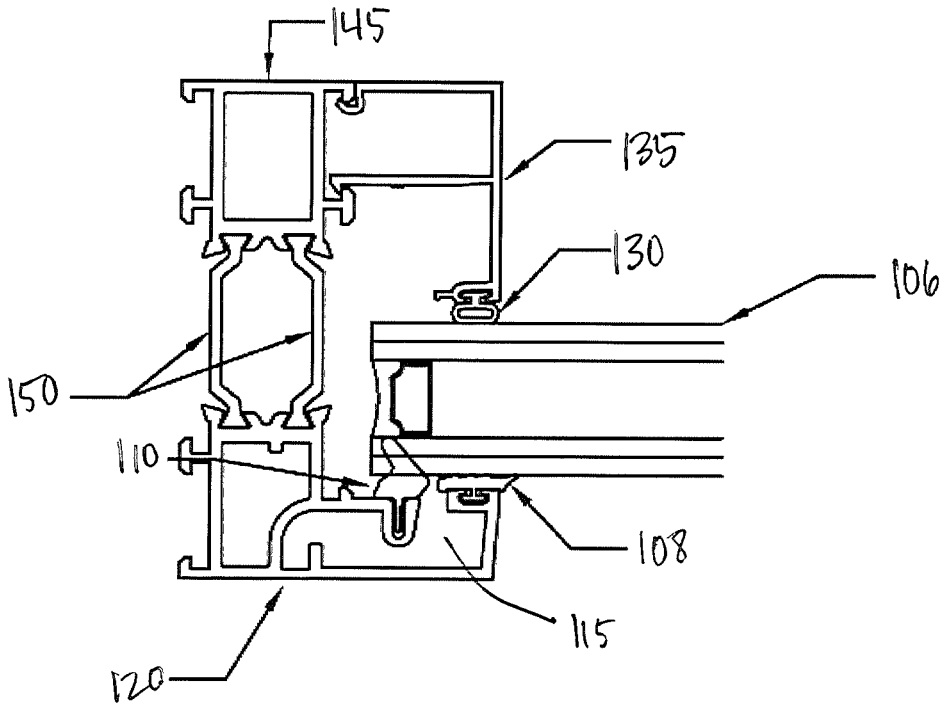
FIG. 3 is a top section view of the jamb (B) of the window.
Figure 4:
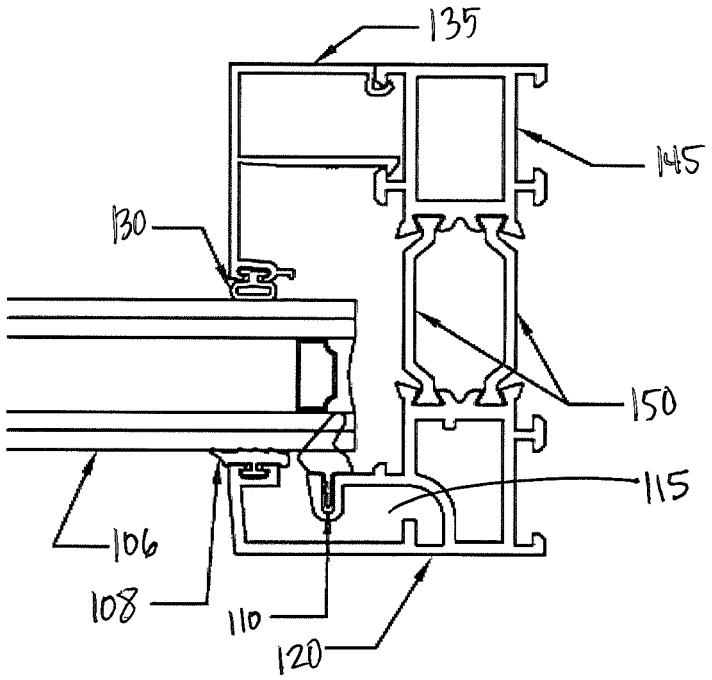
FIG. 4 is a top section view of the jamb (C) of the window.

Attention is now directed to the figures, which illustrate an embodiment of a window system 100. FIG. 1 shows a front view of a window 102 having a head (A), a sill (D), and two jambs (B) and (C). The window 102 may be substantially similar to windows that are now known in the art, or later developed.

Figure 5:
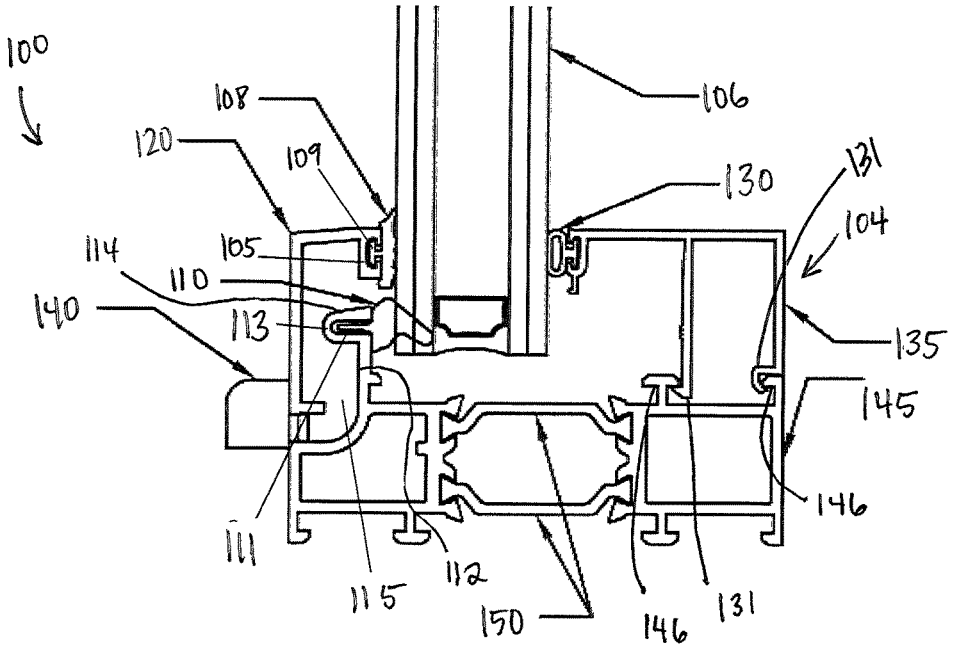
FIG. 5 is a section view of the sill (D) of the window.

FIGS. 2-5 illustrate various section views of the window 102. With specific reference to FIG. 5, which best illustrates the window system 100, a primary (exterior) gasket 108 is disposed between the window pane 106 and the frame 104 acts as a water shed and protects a secondary (internal) gasket 110 from, for example, ultraviolet light, excessive amounts of rain water and cleaning solvents. The primary gasket 108 may be a slide-in gasket mitered to engage with the frame material. For example, as shown in FIG. 5, a tongue 109 on the primary gasket 108 engages with a space 105 in the frame 104 to hold the primary gasket 108 in place. The primary gasket 108 may be slid into engagement with the space 105 in the frame 104 before the pane(s) 106 is placed in the frame 104.

When the pane 106 is placed into position with the frame 104, the primary gasket 108 is compressed between the frame 104 and the pane 106, effectively sealing off the inside of the frame 104. To further prevent entry of elements into the frame 104, the gasket 108 may include an angled upper edge 108*a*. The angle may be configured so that it is positioned away from the pane 6 so that water (or other liquid) may be directed away from the pane 106 and towards the outer edge of the frame 1. In embodiments, the angle may be between 0 and 90 degrees, and preferably between 30 and 60 degrees.

While the primary gasket 108 may prevent a large degree of unwanted element penetration, it may still be possible for water, UV-light, etc. to enter into the frame 104. Disposed inboard of the primary gasket 108, the secondary gasket 110 acts as a continuous seal to prevent any water from entering through the window 102, and may further reduce air infiltration such that the window may meet the strictest AAMA standards. Thus, the secondary gasket 110 is a second means to prevent entry of the elements into the window 102 and ultimately the structure in which the window system 100 is installed. As noted above, as a result of the placement of the primary gasket 108 outboard of the secondary gasket 110, the secondary gasket 110 is not exposed to any elements which could cause it to degrade. Thus, the dual gasket system may give the window system 100 superior durability compared other window, and particularly, glazing systems.

The secondary gasket 110 may be configured to engage with the panes 106 via a unique "J" shaped stem 112 formed in the exterior die/glazing leg 120 of the frame 104. A tongue 111 on the secondary gasket 110 may engage with an opening 113 formed in the "J" shaped stem 112. A top edge 114 of the stem 112 abuts the secondary gasket 110 to provide an additional seal around the frame 104.

The secondary gasket 110 may be a continuous seal installed in one length after the frame 104 is constructed. The secondary gasket 110 may be cut so as to meet beginning and end points at the head (A) of the window frame 104. When compressed, these two ends form a tight seal around the window pane 106. Compression of the panes 106 is achieved by means of an interior compression gasket 130 positioned at a glazing bead 135 of the frame 104. Upon installation, the glazing bead 135, along with the interior compression gasket 130, pushes the panes 106 against the primary 108 and secondary 110 gaskets at the glazing leg 120 of the window frame 104.

Figure 6:
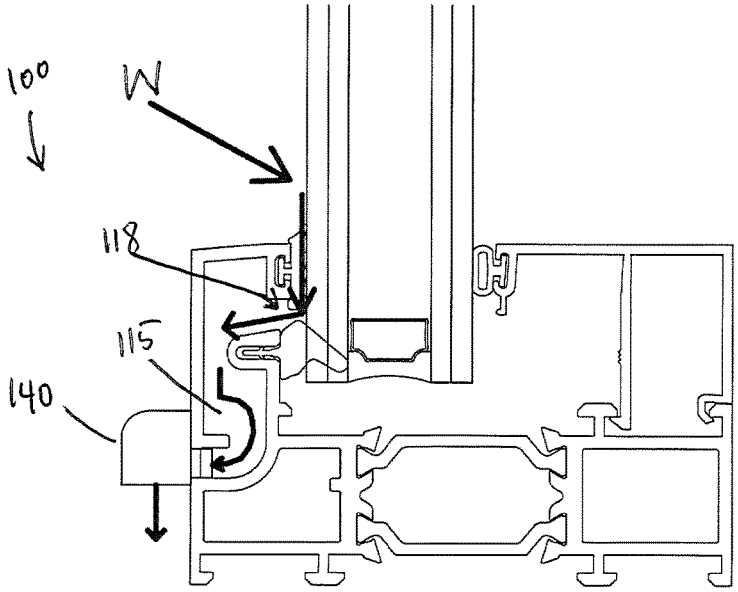
FIG. 6 is the section view of FIG. 5 showing the path of water flowing away from the window.

Moving on, with reference to FIG. 6, a gap 118 is formed between the two gaskets 108 and 110, and provides an alley through which any water (denoted by reference W) that may penetrate the primary gasket 108 is directed. The water W enters into the gap 118 and sheds off the secondary gasket 110, over the top edge 114 of the stem 112 and fall harmlessly into the channel 115 created by the "J" shaped stem 112. The path of the water W (or other liquid) from the exterior of the window 102 and into the channel 115 is represented by the bold arrows in FIG. 6. Once inside the channel 115, the water W is funneled to the exterior of the building through weeps 140 located at an outer edge of the frame sill (D) of window frame 104.

The J-shaped stem 112 (and corresponding channel 115) allows water W to exit from within the frame 104 by directing the water away from the panes 106. Additionally, the unique J-shaped channel 115 prevents water from pooling inside the frame 104, which may then eventually leak into the interior of the window 102 or may cause corrosion of the window frame 104 materials. Those of skill in the art shall understand that while reference is made to water entering into the frame 104, other fluids or solutions may additionally, or alternately, penetrate the primary gasket 108. Such solutions may be harmful to the frame 104 materials, causing corrosion or other unwanted or undesirable reactions.

Figure 8:
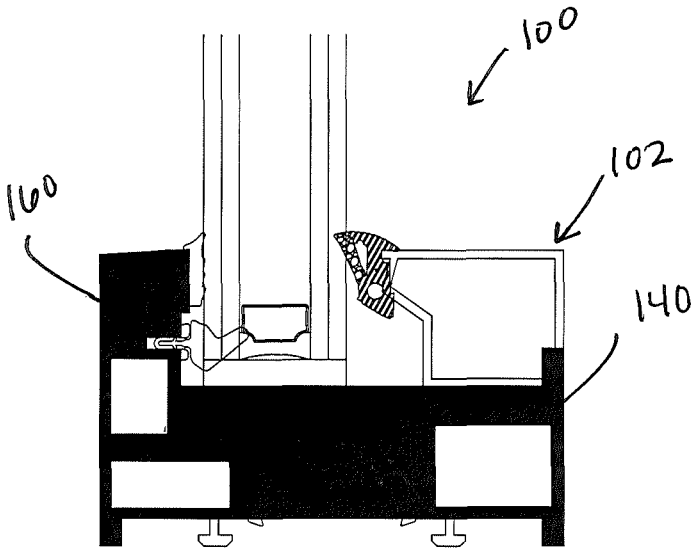
FIG. 8 is a side section view of a corner of the frame of a window, according to an embodiment of the invention.
Figure 9:
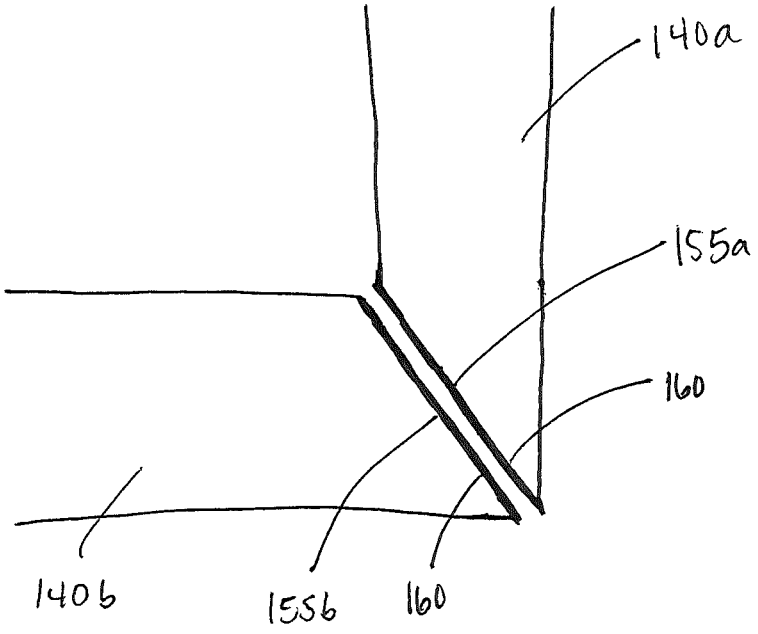
FIG. 9 is a front view of the corner of the window frame of FIG. 8.

The window glazing system 100 may further include corner profile gaskets 160 to provide water proofing capabilities to the corners of the window 102, illustrated in FIGS. 8 and 9. The corner gasket 160 may be substantially flat and configured to mate with the mitered edges 155*a* and 155*b* of the corner piece of frame 140 such that it matches the mitered profile of the corner joint. FIG. 8 shows a front view of a corner joint of a window frame 140. In FIG. 8, the corner joint is angled toward the viewer. The gasket 160, appearing as the shaded portion, is attached, for example, using an adhesive, to the edge of the frame 140. Each corner joint of the window frame 140 may be fitted with a gasket 160. FIG. 9 illustrates two corner joint frame members near the point of connection. Each corner joint frame member, located at the corners of frame piece 140*a* and 140*b* may have a corner gasket 160 that is attached at the respective mitered ends 155*a* and 155*b*. Alternately, one of the corner joint frame members (e.g., either at the corner of frame piece 140*a* or frame piece 140*b*) may have a corner gasket 160 attached to the respective mitered end.

When the two corners 155*a* and 155*b* are brought together, the corner gasket(s) 160 is compressed therebetween. The gasket allows the window system 100 to be handled, and for thermal flexing of the joint, without shearing or breaking the seal. The corner gasket 160 may further allow the window corner to flex during transportation and installation and subsequently conform back to match the mitered profile to maintain a water tight seal.

A thermal break 150 extends between the interior die 145 and the glazing leg 120. The thermal break 150 may provide additional stability to the frame 140, and may further prevent heat transfer across the frame 140.

In embodiments, the frame 104 is made from traditional materials, such as aluminum and is configured to receive the gaskets 108 and 110 as described herein. In other embodiments, alternative materials may be utilized, including but not limited to polyvinyl chloride, fiberglass, wood, etc. Preferably, the material is inherently able to resist the harmful effects of ultraviolet light, or is coated with a material that keeps the UV light from breaking down the material.

The gaskets 108 and 110 may be manufactured from a plastic, polymer, or any other type of appropriate material. Those of skill in the art shall recognize that it is preferable that the material for the gaskets 108 and 110 (and gasket 130) be configured to resist the harmful effects of UV light and corrosive substances.

Figure 7:
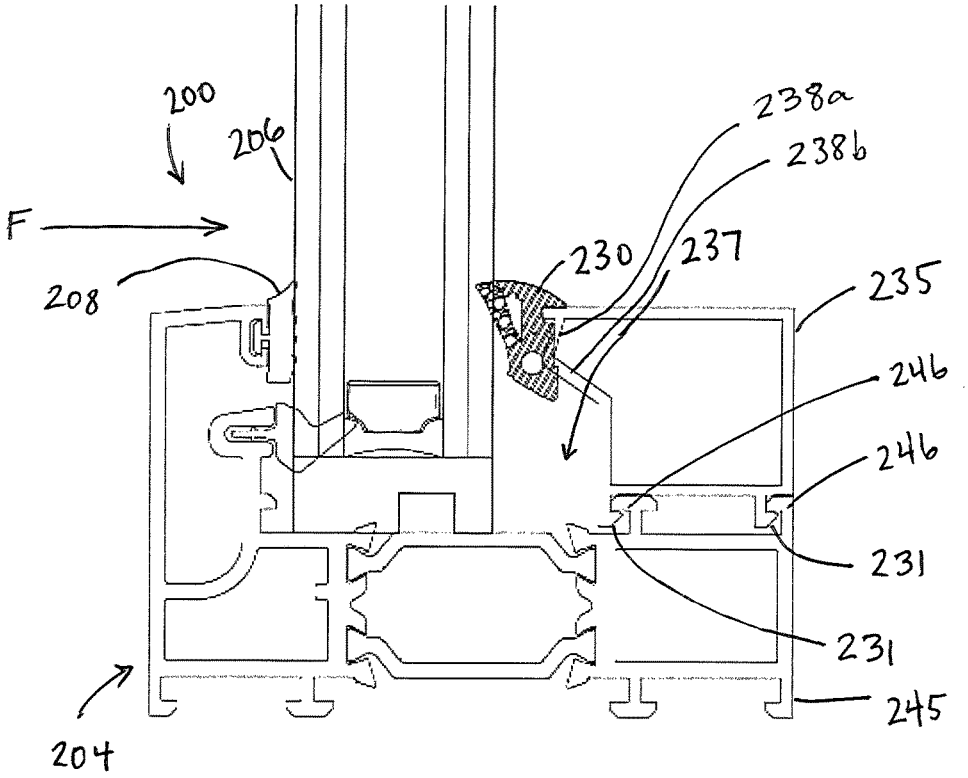
FIG. 7 is a section view of the frame of a window according to another embodiment of the invention.

Another embodiment of a window system 200 is illustrated in FIG. 7. The window system 200 is substantially similar to the window system 100, except as is described below or as would be inherent. For brevity and ease of understanding, reference numbers between 200 and 299 are used to identify the components of the window system 200, and correspond generally to the components identified in window system 100 using reference numbers between 100 and 199.

Here, the frame 204 includes a glazing bead 235 that is specifically configured to provide additional strength to the system 200. Teeth 231 formed as part of the glazing bead 235 interact with respective teeth 246 of the interior die 245. The teeth 231 are identical, and hook into contact with the teeth 246 of the interior die 245 from the same direction. This is in contrast to the glazing bead 135, which has teeth 131 that engage with respective teeth 146 in the interior die 145 from opposite sides (FIG. 5). Here, rather, the teeth 231 are oriented in the same direction such that, when forces F are received upon the panes 206, the teeth 231 pull up on the respective teeth 246, and the panes 260 are prevented from disengagement with the frame 204.

As shown in FIG. 7, the gasket 230 may extend into an opening 237 between the glazing bead 235 and the pane 206, and may abut walls 238*a* and 238*b* of the glazing bead. The interior gasket 230 is configured to interact with the glazing bead 235, and is maintained in position via compression between the glazing bead 235 and the pane 206. The interior gasket 230 may have a larger profile than the interior gasket 130.

Those of ordinary skill in the art shall recognize the many benefits presented as a result of the window glazing system described herein. For example, both gaskets 108 (and corresponding gasket 208) and 110 are easy to apply in a manufacturing setting. Further, inspections on the window are greatly simplified as the gaskets are either present or not, allowing for quick visual inspections. The gaskets additionally eliminating the need for sealant applicators to try and avoid pin sized holes in the sealant which are nearly impossible to detect and can cause a great amount of damage.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

The invention claimed is:

1. A window system, comprising:

a window frame surrounding a window unit, the window frame comprising a glazing leg and a glazing bead separated by a thermal break;

the glazing leg comprising a J-shaped stem forming a J-channel configured to direct liquid away from the window unit;

an outer gasket disposed between the glazing leg and the window unit; and an internal gasket disposed between the J-shaped stem of the glazing leg and the window unit inboard of the outer gasket;

wherein:

the glazing leg is disposed on a first side of the window unit and the glazing bead is disposed on a second side of the window unit; and liquid passing between the outer gasket and the window unit is directed into the J-shaped channel via the internal gasket.

2. The window system of claim 1, wherein the glazing leg comprises an outer wall and an inner wall, the inner wall forming the J-shaped stem and the J-channel being disposed between the outer wall and the J-shaped stem.

3. The window system of claim 2, wherein a portion of the outer wall generally abuts the window unit, the portion forming an opening for receiving the outer gasket, the outer gasket being compressed between the outer wall and the window unit.

4. The window system of claim 3, wherein an upper end of the J-shaped stem forms an opening for receiving the internal gasket.

5. The window system of claim 4, wherein the internal gasket is compressed between the J-shaped stem and the window unit.

6. The window system of claim 1, wherein the liquid exits the J-shaped channel through weeps formed in the outer wall.

7. A window system, comprising:

an insulated glass unit having a first side and a second side; and a window frame surrounding the insulated glass unit, comprising:

a glazing leg having an outer wall and a J-shaped inner wall, the outer wall forming a first opening for receiving a first gasket and the inner wall forming a second opening for receiving a second gasket, wherein the first gasket is disposed between the glazing leg and the first side of the insulated glass unit and the second gasket is disposed inboard of the first gasket between the glazing leg and the first side of the insulated glass unit; and a weep positioned outside the glazing leg;

wherein:

the the first and second are compressed between the glazing leg and the insulated glass unit;

the J-shaped inner wall forms a respective J-shaped channel within the glazing leg, the J-shaped channel configured to re-direct fluid away from the insulated glass unit; and the weep directs fluid out of the J-shaped channel.

8. The window system of claim 7, wherein the first gasket comprises opposing sidewalls, an upper edge and a lower edge, and a tongue extending outwardly from one of the sidewalls and being received into the first opening in the glazing leg, the other sidewall abutting the insulated glass unit.

9. The window system of claim 8, wherein the upper edge of the first gasket is angled such that liquid is directed away from the insulated glass unit.

10. The window system of claim 9, wherein the second gasket comprises a body and a tongue extending from the body, the tongue being received into the second opening in the glazing leg.

11. The window system of claim 10, wherein the second gasket is compressed between the glazing leg and the insulted glass unit, the compression causing deformation of the second gasket.

12. A window system, comprising:

a window frame surrounding a window unit, the window frame comprising:

a glazing leg comprising an outer wall and an inner wall, the inner wall forming a J-shaped stem, the J-shaped stem forming a J-shaped channel between the outer wall and the inner wall;

wherein:

a first gasket engages with the outer wall and is maintained in compression between the outer wall and the window unit; and a second gasket engages with the inner wall and is maintained in compression between the inner wall and the window unit; and the outer wall comprises openings to allow liquid to escape from the J-shaped channel.

13. The window system of claim 12, wherein the outer wall comprises an opening configured to receive a tongue forming a part of the first gasket.

14. The window system of claim 13, wherein the inner wall comprises an opening configured to receive a tongue forming a part of the second gasket.

15. The window system of claim 12, wherein the first gasket comprises a mitered edge, the mitered edge being outwardly exposed between the outer wall and the window unit and positioned so as to direct liquid away from the window unit.

16. A window system, comprising:

a window frame surrounding a window unit, the window frame comprising a glazing leg and a glazing bead separated by a thermal break;

the glazing leg comprising a J-shaped stem forming a J-channel configured to direct liquid away from the window unit;

an outer gasket disposed between the glazing bead and the window unit; and an internal gasket disposed between the J-shaped stem of the glazing bead and the window unit inboard of the outer gasket;

wherein:

liquid passing between the outer gasket and the window unit is directed into the J-shaped channel via the internal gasket.

17. A window system, comprising a window unit surrounded by a window frame, the window frame comprising a glazing leg and a glazing bead separated by a thermal break; the glazing leg comprising a J-shaped stem forming a J-channel, the J-channel being oriented away from the window unit;

wherein:

the glazing leg is disposed on a first side of the window unit and the glazing bead is disposed on a second opposing side of the window unit; and openings in the glazing bead allow liquid to escape from the J-shaped channel.

* * * * *